United States Patent [19]

Guerra et al.

[11] 4,406,615

[45] Sep. 27, 1983

[54] IGNITER FOR A GAS DISCHARGE PIPE

[75] Inventors: Romeo E. Guerra, Richardson; Robert H. Nelson, Plano, both of Tex.

[73] Assignee: Nova Patents of North America, Inc., Dallas, Tex.

[21] Appl. No.: 284,548

[22] Filed: Jul. 20, 1981

[51] Int. Cl.[3] ..... F23Q 9/00

[52] U.S. Cl. ..... 431/278; 431/202; 431/264; 431/343; 431/355

[58] Field of Search ..... 431/4, 13, 202, 255, 431/263, 264, 278, 343, 353, 354, 355

[56] References Cited

U.S. PATENT DOCUMENTS

| | | | |
|---|---|---|---|
| 2,203,554 | 6/1940 | Uhri et al. | 431/202 |
| 2,460,016 | 1/1949 | Kuhn | 431/202 |
| 2,648,376 | 8/1953 | Schrader | 431/202 |
| 2,693,937 | 11/1954 | Wyland | 431/202 |
| 2,696,875 | 12/1954 | Henwood | 431/202 |
| 2,855,987 | 10/1958 | Schylander | 431/343 |
| 2,869,631 | 1/1959 | Zink | 431/202 |
| 3,315,745 | 4/1967 | Rees | 431/202 |
| 3,729,287 | 4/1973 | Strashok | 431/202 |
| 3,914,094 | 10/1975 | Landry | 431/202 |
| 3,932,111 | 1/1976 | Liknes et al. | 431/202 |

FOREIGN PATENT DOCUMENTS

| | | | |
|---|---|---|---|
| 910527 | 11/1962 | United Kingdom | 431/263 |

*Primary Examiner*—Carroll B. Dority, Jr.
*Assistant Examiner*—Noah Kamen
*Attorney, Agent, or Firm*—James E. Bradley

[57] ABSTRACT

An igniter for gas discharge pipes such as flare lines produces a remotely controlled flame. The igniter has a tubular housing that is mounted to the gas discharge pipe. A fuel line extends through the housing and terminates in a nozzle. A swirling device creates a swirling motion in the nozzle to prevent extinguishment due to high winds. An electrical system creates an electrical spark in the nozzle to ignite the fuel. An auxiliary line provides fuel unmixed with air to the nozzle to enrichen the mixture and provide coloration to the flame. The nozzle extends laterally from the housing. The mounting means allows the nozzle to discharge the flame across the face of the discharge pipe. A heat shield protects the upstream end of the housing from heat due to the discharge pipe.

2 Claims, 5 Drawing Figures

IGNITER FOR A GAS DISCHARGE PIPE

BACKGROUND OF THE INVENTION

This invention relates in general to devices for igniting a gas, and in particular to an igniter for igniting a gas being flared from a gas discharge pipe such as in oil and gas well drilling and production.

In oil and gas well drilling, a drill bit is rotated by a string of drill pipe from a drill rig. Drilling fluid, normally a liquid containing water and various chemicals known as "mud," is pumped down the drill pipe, and circulated up the annulus surrounding the drill pipe. The mud returns formation cuttings to the surface, cools the drill bit and also prevents the well from blowing out. The weight of the mud is selected so that it will exert a greater hydrostatic force than the formation pressure to prevent formation fluids from blowing the mud out of the hole.

It is not uncommon to experience gas kicks that blow a certain amount of mud from the well and result in a large gas bubble that flows to the surface. Often this is due to unexpected high pressure zones. When this occurs, the drill pipe can be sealed at the rig floor, with the gas being discharged out a flare line, which extends outward from the drill rig about 250 feet or so, if possible. Flare lines or gas discharge lines are also used in well production and drill stem testing operations, wherein the well is tested by isolating the formation from well hydrostatic pressure and allowing the formation fluid to flow upward through the drill pipe to the surface. Gas is also flared in certain production operations through vertical flares.

It is necessary to burn the gas being discharged out the flare line. This is sometimes a problem because of the poor quality of the gas being produced. Mud, acid, and other liquids will blow out the flare line along with the gas, thus tending to extinguish any flame. In the prior art technique for nonvertical lines, a bucket containing a liquid fuel or material soaked with fuel is placed and ignited near the end of the flare line to ignite any gas being produced out the flare line. The liquids being discharged often extinguish the flame of the igniting materials. Re-igniting is dangerous for operating personnel because of the proximity to the flare line when igniting the gas.

In the prior art vertical stack techniques, a fuel soaked rag or the like might be ignited and thrown upward in the vicinity of the stack. Also, burners have been placed inside stacks, but they eventually failed because of high temperatures.

SUMMARY OF THE INVENTION

An igniter is provided particularly for use with oil and gas well discharge pipes, but also useful with stacks or discharge pipes of industrial application in general. The igniter includes a tubular housing that is mounted to the exterior of the flare line near the end. A fuel line extends through the tubular housing, with one end of the fuel line being connected to a source of gaseous fuel. The downstream end of the fuel line terminates in a nozzle. Preferably, a swirl means is located in the nozzle for creating a swirling motion to the gas being discharged. The nozzle extends laterally from the tubular housing to discharge a gaseous stream across the face of the discharge pipe. A pair of electrodes are mounted in the nozzle for igniting the gaseous fuel to create a flame for discharging across the nozzle. The electrodes are connected to an energy source controlled by a remote control, preferably located at the rig floor.

Other features of the igniter include an auxiliary line that delivers gaseous fuel to the nozzle without any mixing of air. The discharge of this pure fuel adds coloration to the flame, enabling rig personnel to determine that the igniter is lit. A heat shield surrounds the upstream end of the housing to reduce the temperature resulting from a large flame being produced at the gas discharge line.

DESCRIPTION OF THE PREFERRED EMBODIMENT

Figure 2:
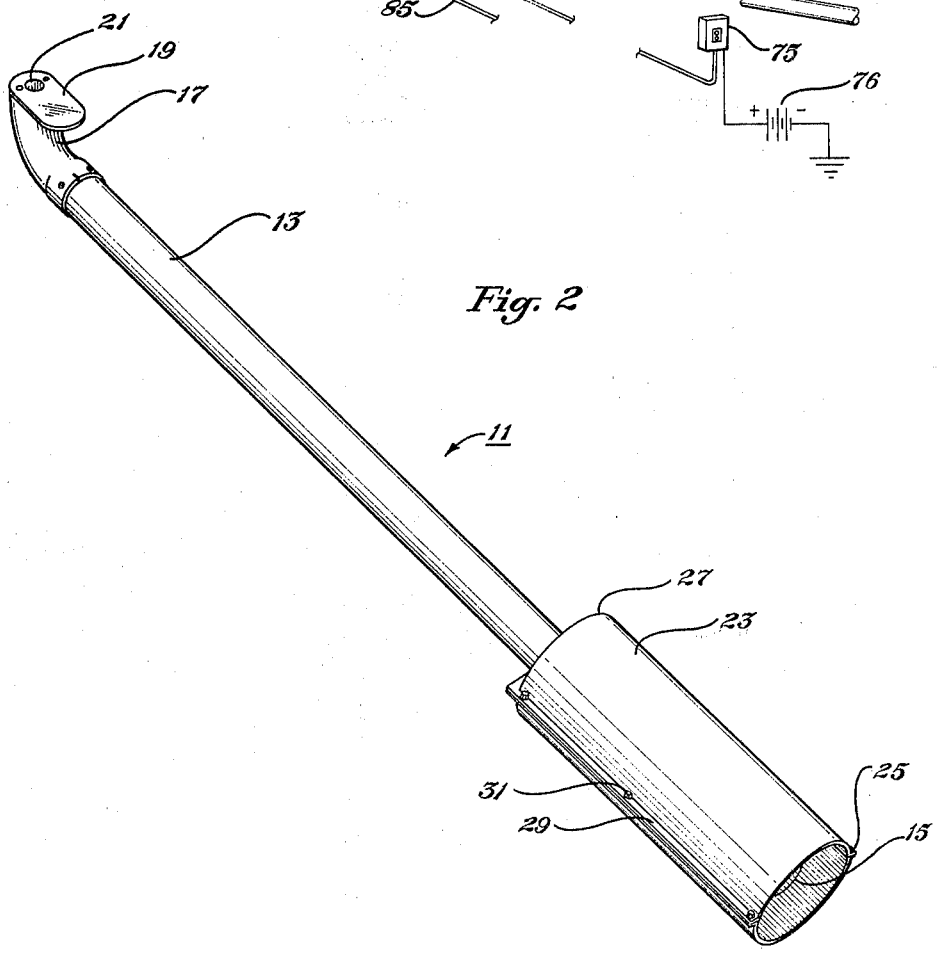
FIG. 2 is an enlarged perspective view of the igniter of FIG. 1.

Referring to FIG. 2, igniter 11 includes a tubular housing 13. Housing 13 is a straight cylindrical pipe having an open rearward or upstream end 15. The downstream end 17 comprises a tubular elbow or member that is curved 45 degrees. A flat plate or flange 19 is secured to the downstream end 17 and extends parallel with the axis of the straight portion of housing 13. An aperture 21 is located in flange 19 for discharging a flame from igniter 11.

A heat shield 23 of a length about one fourth that of housing 13 is secured to the upstream end of housing 13. Heat shield 23 is a two-piece tubular member of a diameter about twice that of the housing 13. The upstream end 25 of heat shield 23 protrudes rearwardly a few inches past the upstream end 15 of housing 13 and is also open. The downstream end 27 of heat shield 23 has a hole of diameter equal to housing 13 for tightly securing heat shield 23 to the housing. A pair of flanges 29 connect the two halves of the heat shield 23 by means of bolts 31.

Figure 3:
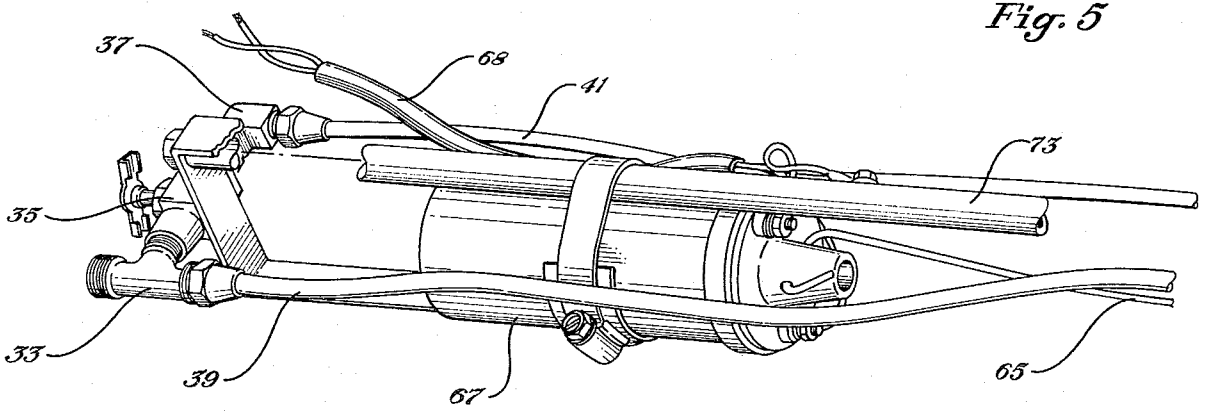
FIG. 3 is an enlarged view of the upstream end of the igniter, with the housing removed.

Referring to FIG. 3, a "T" shaped fitting or manifold 33 has threads for securing to a source of gaseous fuel such as propane. Manifold 33 has another set of threads for connection to a valve 35, which in turn is connected to an "L" shaped fitting 37. The third connection to manifold 33 is to a main gas line 39. The "L" shaped fitting 37 is connected to an auxiliary gas line 41, with valve 35 controlling the amount of fuel that will flow through auxiliary line 41.

Figure 1:
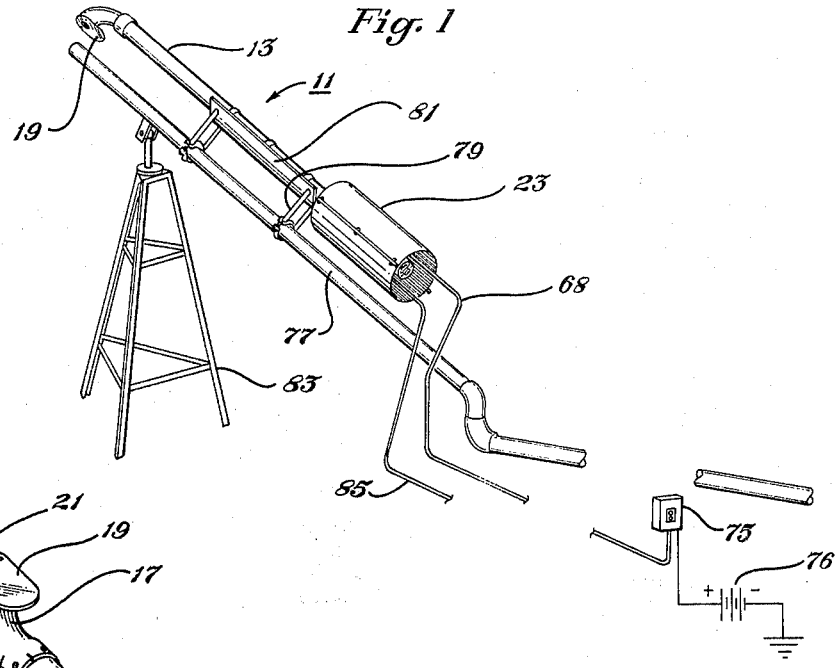
FIG. 1 is a perspective view of an igniter constructed in accordance with this invention, shown mounted to a gas discharge line.
Figure 4:
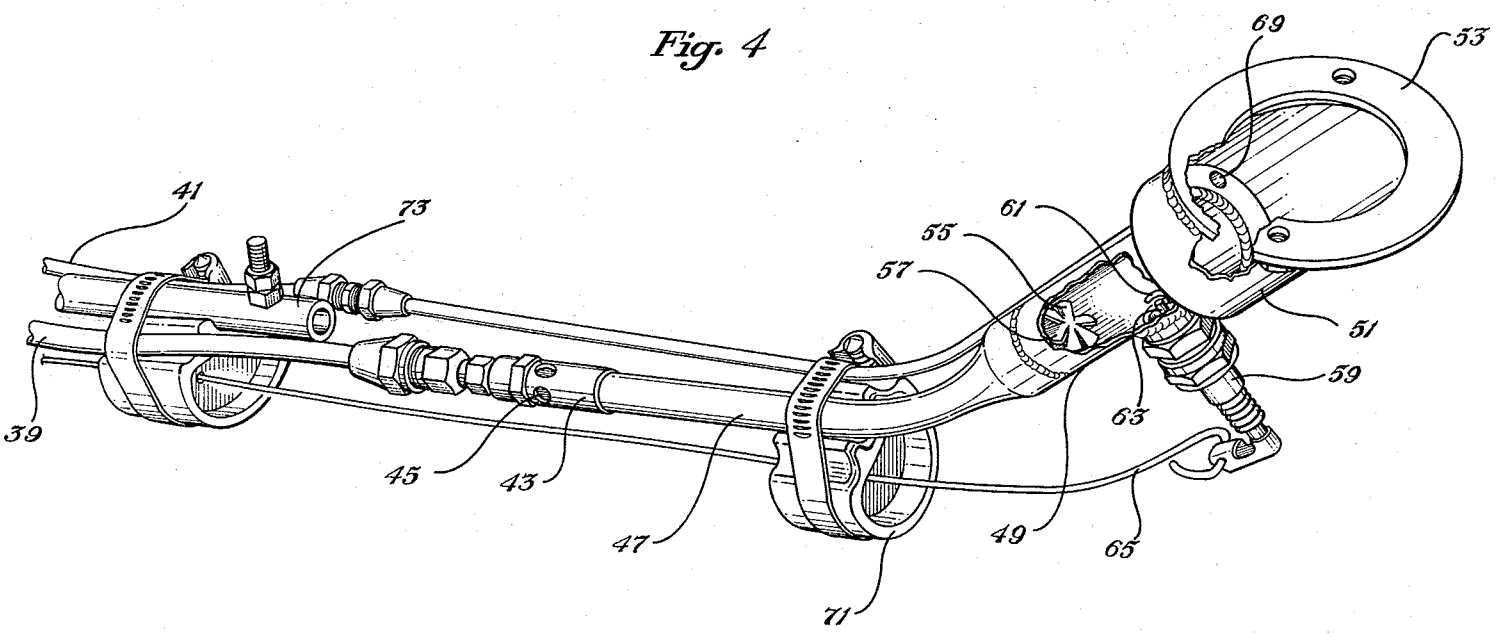
FIG. 4 is an enlarged perspective view of the downstream end of the igniter of FIG. 1, with the housing removed.

Referring to FIG. 4, main gas line 39 extends to a port means 43 which has apertures 45 of selected size for introducing air to the gaseous fuel flowing through the main fuel line 39. A nozzle section 47 extends downstream from the port means 43. Nozzle section 47 is tubular and of larger diameter than the main fuel line 39. Nozzle section 47 is bent gradually at an acute angle and extends to a larger diameter cylindrical section 49. Nozzle section 49 is a straight tubular member of diameter several times that of the main fuel line 39. A nozzle section 51 of diameter about twice the diameter of section 49 is secured to the downstream end of section 49 and forms the downstream end of igniter 11. Section 51 is a straight cylindrical member, but its downstream end is cut at an acute angle with respect to its axis and covered by an annular flange 53. Flange 53 fits sealingly against flange 19 encircling aperture 21 (FIG. 1). The bend in section 47 and the angle at which the downstream end of section 51 is cut, results in flange 53 being in a plane that is parallel with the axis of housing 13. The total angle of change from port means 43 to the end of the nozzle section 51 is about 45 degrees.

A swirl means 55 is mounted in section 49. Swirl means 55 in the preferred embodiment consists of a plurality of blades 57 each of which have a pitch or inclination with respect to the fuel flow for causing the swirling action. Blades 57 are rigidly coupled together and rigidly mounted in section 49.

A conventional internal combustion spark plug 59 is mounted to section 49. Spark plug 59 has two spaced-apart electrodes 61 and 63 inside of section 49. Electrode 61 is grounded to section 49, while electrode 63 is connected to a wire 65 for supplying electrical energy. Referring again to FIG. 3, wire 65 is connected to a conventional motor vehicle coil 67 which supplies high voltage DC current to spark plug 59. A wire 68 leads from coil 67 to an energy source.

Referring again to FIG. 4, the auxiliary line 41 extends the length of igniter 11 and has a downstream end 69 located in section 51. Other structure of the igniter 11 includes insulators 71 for insulating wire 65 and supporting it. A shaft 73 (only partially shown) extends the length of igniter 11 for supporting the fuel lines 39 and 41 and insulators 71.

Figure 5:
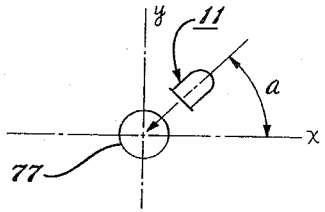
FIG. 5 is a schematic end view of the igniter of FIG. 1.

Referring to FIG. 1, a remote control box 75 is preferably mounted at the rig floor or another remote point and connected to wire 68. Control box 75 is connected to a battery 76 for supplying current to coil 67 (FIG. 3). Mounting means for mounting the igniter 11 to a discharge pipe 77 depend upon the type of discharge pipe. In the case of a nonvertical discharge pipe, as shown, the mounting means is preferably a pair of clamps 79 that are clamped about discharge pipe 77. A channel member 81 is secured between clamps 79. Housing 13 is bolted to channel member 81 by suitable brackets. The clamps 79 are located so that the flame projected by igniter 11 will discharge downwardly across the face or end of discharge pipe 77 at an angle of about 45 degrees. As shown in FIG. 5, the flame projected by igniter 11 will be perpendicular to the axis of discharge pipe 77, but inclined so that it would be in the first quadrant of an X-Y coordinate system. The second quadrant, which is the quadrant bounded by positive Y and negative X would also be acceptable. The length of the flame projected by igniter 11 will be greater than the heights of clamps 79, so that it will discharge completely across the face of discharge pipe 77. Discharge pipe 77 will often be located on a tripod or stand 83 as shown. In the case of a vertical discharge pipe 77, flange 19 may hang over the lip or upper edge of the discharge pipe.

To install the igniter 11, it will be placed in the position described on a discharge line 77. Electrical wire 68 will be connected to control box 75, which is connected to battery 76, both of which will be mounted at a remote location. A conduit 85 leading from a source of gaseous fuel will be connected to manifold 33 (FIG. 3).

In operation, whenever it is conceivable that gas might be discharged from gas discharge line 77, the igniter 11 should be in operation. To light the igniter, a gaseous fuel from a remote location is supplied to manifold 33 through conduit 85. As shown in FIG. 4, air will mix with the fuel flow through port apertures 45, with the air/fuel mixture discharging through swirl means 55 and swirling about the section 49. Electrical energy will be provided by pressing the proper control button at the control box 75, which sends DC current through coil 67 and to spark plug 59. Spark is generated between electrodes 61 and 63, igniting the swirling fuel air mixture. This results in a flame being discharged out through section 51.

To provide coloration to assure to the operating personnel that a flame exists, a measured amount of fuel, without any air being mixed in it, is discharged into section 51, where it burns and adds the yellow coloration to the flame. All fresh air supplied to ports 45 comes from the open upstream end 15, the downstream end 17 (FIG. 2) of the housing being sealed to the nozzle section 51. The flame will ignite gas being discharged out gas pipe 77. The igniter can be turned off by cutting off the fuel flowing through conduit 85.

In the preferred embodiment, spark plug 59, coil 67, control box 75 and the battery provide electrical spark means for creating an electrical spark in the nozzle to ignite the fuel. The auxiliary line 41, manifold 33 and valve 35 provide means for enriching the air/fuel ratio at the nozzle to add coloration to the flame. Sections 49 and 51 serve as a nozzle for the igniter.

The invention has significant advantages. The igniter can be operated from a remote location to avoid danger to personnel that might otherwise have to light by hand a gas discharge. The swirl means 55 and the nozzle extension 51 prevent the igniter flame from being extinguished even in a high wind. The positioning of the igniter above the gas discharge, in the case of nonvertical flare lines, avoids the igniter being plugged or extinguished from heavy liquids being blown from the pipe. Positioning the igniter in the first or second quadrants at a 45 degree angle locates it out of the most extreme heat, which would be directly above the flare. The heat shield avoids damage to the coil and associated valves and components on the upstream end of the igniter. A supply of fresh air for mixing is available from the upstream end.

While the invention has been shown in only one of its forms, it should be apparent to those skilled in the art that it is not so limited but is susceptible to various changes and modifications without departing from the spirit of the invention.

We claim:

1. An igniter for a gas discharge pipe, comprising:

a tubular housing having a downstream end and an upstream end;

a fuel line extending in the housing and spaced therefrom, having one end adapted to be connected to a source of gaseous fuel and the other terminating in a nozzle at the downstream end of the housing;

port means located in the fuel line near the downstream end of the housing adjacent the nozzle for mixing air with the fuel to create a combustible air/fuel mixture;

said housing extending past said port means in an upstream direction;

seal means between the downstream end of the housing and the downstream end of the nozzle for requiring air entering the port means to be drawn from the upstream end of the housing; and electrical spark means for creating an electrical spark in the nozzle to ignite the air/fuel mixture.

2. An igniter for a gas discharge pipe, comprising:

a tubular housing having a downstream end and an upstream end;

fuel line means extending into the housing, having one end adapted to be connected to a source of gaseous fuel and the other terminating in a nozzle at the downstream end of the housing;

port means in the fuel line means near the downstream end of the housing adjacent the nozzle for admitting air to the fuel to make a combustible air/fuel mixture immediately before the nozzle;

said tubular housing surrounding said fuel line means in spaced relation and extending upstream past said port means;

seal means between the downstream end of said housing and the downstream end of said nozzle to prevent air in the vicinity of the discharge of the nozzle from entering the port means, the housing being closed to the atmosphere except at the upstream end so as to require all air being drawn into the port means to enter from the upstream end;

electrical spark means for creating an electrical spark in the nozzle to ignite the air/fuel mixture; and mounting means for mounting the igniter to the exterior of a gas discharge pipe so that the nozzle discharges a flame across the face of the discharge pipe.

* * * * *